US005274308A

United States Patent [19]

Park et al.

[11] Patent Number: 5,274,308

[45] Date of Patent: Dec. 28, 1993

[54] CONVERGENCE CORRECTING DEVICE

[75] Inventors: Tae J. Park; Cheong M. Lee, both of Suweon, Rep. of Korea

[73] Assignee: Samsung Electro-Mechanics Co., Ltd., Suweon, Rep. of Korea

[21] Appl. No.: 6,201

[22] Filed: Jan. 19, 1993

Related U.S. Application Data

[63] Continuation of Ser. No. 705,128, May 24, 1991, abandoned.

[30] Foreign Application Priority Data

May 24, 1990 [KR] Rep. of Korea ..... 90-7102[U]
Jun. 30, 1990 [KR] Rep. of Korea ..... 90-9679[U]

[51] Int. Cl.[5] ..... G09G 1/04; H01J 29/70; H01H 1/00

[52] U.S. Cl. ..... 315/368.26; 315/368.28; 315/400; 335/213

[58] Field of Search ..... 315/400, 368.26, 368.27, 315/368.28, 368.25; 335/213

[56] References Cited

U.S. PATENT DOCUMENTS 4,588,930 5/1986 Kobayashi et al. ..... 315/400
4,642,528 2/1987 Kobayashi et al. ..... 315/400
4,704,564 11/1987 Ito et al. ..... 315/400

*Primary Examiner*—Gregory C. Issing
*Attorney, Agent, or Firm*—Ladas & Parry

[57] ABSTRACT

A convergence correcting device is disclosed in which a first correcting element varies an inductance of horizontal correcting coils so as to correct a misconvergence in a saturable region of a flux generated according to the horizontal correcting coils of the saturable reactor, and the second correcting element corrects a misconvergence by increasing a flux density at the vertical side of the saturable reactor after focusing magnetic fields generated from vertical correcting coils and the magnet.

12 Claims, 5 Drawing Sheets

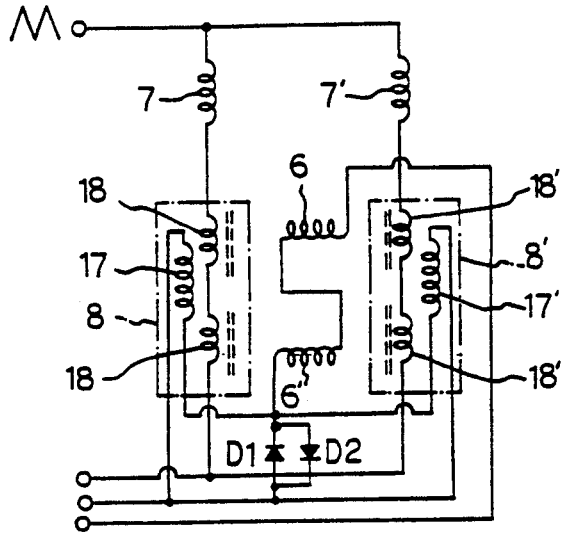
FIG. 4
PRIOR ART
FIG. 5(A)
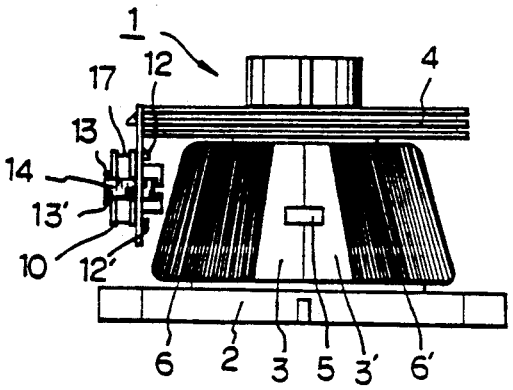
FIG. 5(B)
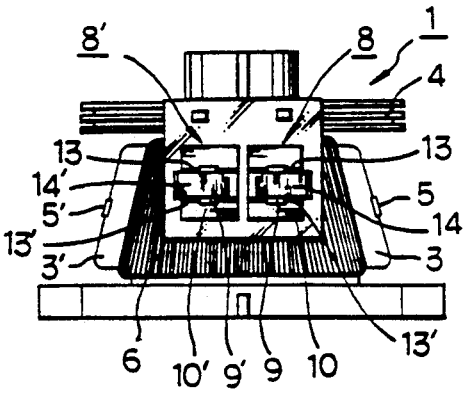
FIG. 6
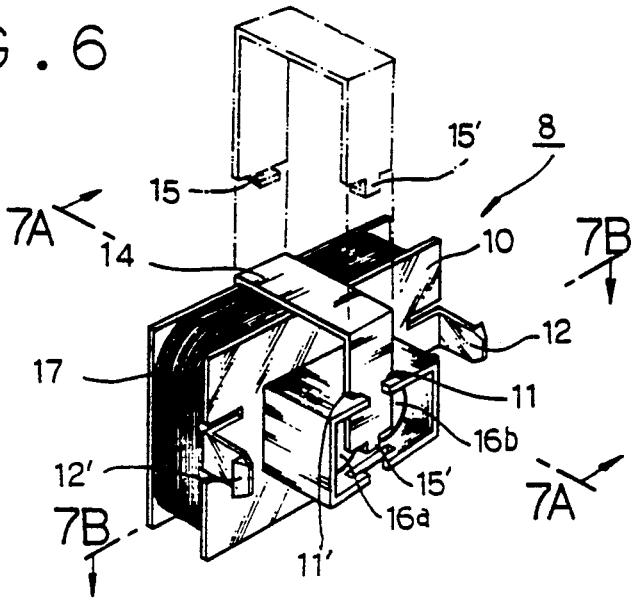

CONVERGENCE CORRECTING DEVICE

This is a continuation of copending application Ser. No. 07/705,128 filed on May 24, 1991, now abandoned.

FIELD OF THE INVENTION

The present invention relates to a convergence correcting device for making a beam from an electron gun of a cathode ray tube converged into a hole of a shadow mask, and particularly to a converge correcting device in which a saturable reactor is used in order to correct misconvergences and distortions appearing on the picture after matching the cathode ray tube and a deflection yoke, thereby obtaining a high quality picture.

BACKGROUND OF THE INVENTION

Generally, a deflection yoke consists of a pair of horizontal deflection coils and a pair of vertical deflection coils which produce magnetic fields for deflecting the beams from the electron gun in the horizontal and the vertical directions, respectively.

Particularly, in color monitors and color television receivers having three electron gun type, the three beams of red, green and blue colors are not converged into a single point due to the mechanical deviations of the deflection yoke or the radius of curvature (comma aberration), thereby producing a misconvergence phenomenon.

Therefore there is used a self convergence method in which the horizontal deflection coils produce pin cushion type magnetic fields, and the vertical deflection coils produce barrel shaped magnetic fields in order to generate a distortion. In such a case, the magnetic fields are distorted, with the result that the focus becomes degraded, and that there is a limit in correcting the misconvergence phenomenon, thereby making it impossible to obtain a stable picture.

That is, as for the trilemma which shows the characteristics when matching the cathode ray tube and the deflection coils, if the size of the cathode ray tube is 16 inches, the trilemma has negative characteristics. As shown in FIG. 1, the red and blue beams are accurately converged over the central portion of the picture so that no misconvergence is produced, but the red and blue beams cross each other to produce a misconvergence along the upper and lower peripheries.

The usual deflection yolk is constituted such that: a pair of horizontal coils 7, 7' are installed within a coil separator 2 as a part of the deflection yolk 1; a pair of vertical deflection coils 6,6' wound around a pair of ferrite cores 3, 3' are fixedly installed on the outside of the tube neck; a neck portion 4 for accommodating an electron gun is formed on the top of the coil separator 2; and a pair of saturable reactors 8, 8' are assembled to the neck portion 4.

Japanese patent No. sho. 62-23695 describes in detail the conventional technique using a saturable reactor which is capable of correcting the misconvergence of a cathode ray tube.

That is, as shown in FIGS. 2 to 4, the saturable reactor 8, 8' are disposed on the opposite sides where there is no vertical deflection coils 6, 6' which is wound around the ferrite cores 3, 3' which are in turn fixed by means of clamp 5, 5'.

Further, the saturable reactors 8, 8' are constituted such that: horizontal correcting coils 18, 18' are wound on I-shaped drum cores 16*a*–16*d*; dc magnetic field biasing magnets 9, 9' installed on the drum cores 16*a*–16*d* are accommodated within a case; and vertical correcting coils 17, 17' are installed on the outside of the case.

Further, the saturable reactors 8, 8' matched in an inverse form are connected to the horizontal deflection coils 7, 7', and the polarities of the magnets 9, 9' having a flux density of 300–600 Gauss are disposed in opposite directions. Further, the magnets 9, 9' are connected to the vertical correcting coils 17, 17', and diodes D1, D2 are connected to the vertical correcting coils 17, 17' in inverse polarities.

Now description will be made for the case where an inverse trilemmas pattern produced in a cathode ray tube is corrected using the conventional convergence correcting device constituted as above. It is assumed that the inverse direction exists between the magnetic fluxes of the vertical correcting coils 17, 17' and the leakage magnetic fluxes of the horizontal correcting coils 18, 18'. Then, the magnetic fluxes acting on the saturable reactors 8, 8' deflects the electron beam up to the middle position of the vertical deflecting direction owing to the threshold values of the diodes D1, D2. Under these conditions, the opposite terminal voltages of the vertical correcting coils 17, 17' become the same as each other, and therefore, the misconvergence pattern of the lateral line can be corrected by nonlinearly varying the control magnetic fields and by varying the turn ratio between the vertical deflection coils 6, 6' and the horizontal correcting coils 17, 17'.

In this conventional convergence correcting device, diodes are used on the vertical correcting coils, and the saturable reactors are installed at the contact portions of the ferrite cores in order to utilize the leakage magnetic fluxes of the vertical coils. This brings the results that product deflects are liable to occur depending on the assembling conditions, that the landing characteristics are changed by the strong magnets having a flux density of 300–600 Gauss, and that the manufacturing cost are raised due to the requirement of special diodes suiting to the misconvergence characteristics.

Meanwhile, there is another correcting method which is constituted such that: the 4 corners of the picture are adjusted by means of vertical deflecting coils; and the misconvergences deviated in the horizontal direction from the Y axis are corrected by an additional means.

In this method, however, the peripheral portions are properly corrected, but the central portion is over-corrected, thereby making it impossible to achieve proper corrections of misconvergences.

SUMMARY OF THE INVENTION

The present invention is intended to overcome the above described disadvantages of the conventional techniques.

Therefore it is an object of the present invention to provide a convergence correcting device in which misconvergences occurring on the upper and lower peripheries of a cathode ray tube can be accurately corrected, by forming a new saturable reactor including a first correcting means for varying an inductance of horizontal correcting coils in accordance with the magnetic fields of the vertical correcting coils and a second correcting means for focusing the magnetic fields by means of magnet pieces.

It is another object of the present invention to provide a convergence correcting device which is capable of correcting the distortions occurring on the left and right corners of the picture by using a first and second correcting means due to the weakening of the horizontal magnetic field by the vertical magnetic field due to the trend of the increase of the inductance of the horizontal deflection.

It is still another object of the present invention to provide a saturable reactor in which the convergence characteristics are improved by installing magnet pieces for focusing the magnetic fields between a fixing step and a slot formed on a side of a bobbin, and by firmly securing the drum cores and the magnets inserted into a bobbin.

In achieving the above objects, the convergence correcting device according to the present invention includes saturable reactors installed on the sides of the neck portion of the deflection yoke in order to correct the misconvergences occurring on the picture, and further includes: slots formed on a side of each of the bobbins in an opposing manner; securing steps formed on another side of each of the bobbins in a symmetrical form; and a magnet pieces installed between the slots and the securing steps, so as for the drum cores and the magnets having a flux density of 30–50 Gauss to be firmly secured, thereby forming a saturable reactor attached on the deflecting yoke for focusing the magnetic fluxes by means of the magnet pieces.

BRIEF DESCRIPTION OF THE DRAWINGS

The above objects and other advantages of the present invention will become more apparent by describing in detail the preferred embodiment of the present invention with reference to the attached drawings in which:

FIG. 4 is a circuit diagram of the conventional convergence correcting circuit;

FIGS. 5A and 5B are front side views showing the deflection yoke with the saturable reactor of the present invention attached thereon;

FIGS. 6 is a perspective view of the saturable reactor according to the present invention;

DESCRIPTION OF THE PREFERRED EMBODIMENTS

FIGS. 5A and 5B are side and front views shown a deflection yoke mounted with saturable reactors 8,8' according to the present invention. As shown in these drawings, the two saturable reactors 8,8' which are capable of correcting the misconvergences appearing on the upper and lower parts of the picture are attached on a neck portion 4 of the deflection yoke 1, and the saturable reactors 8,8' are secured into insertion holes of the base plate by means of engaging pieces 12,12'.

Figure 1:
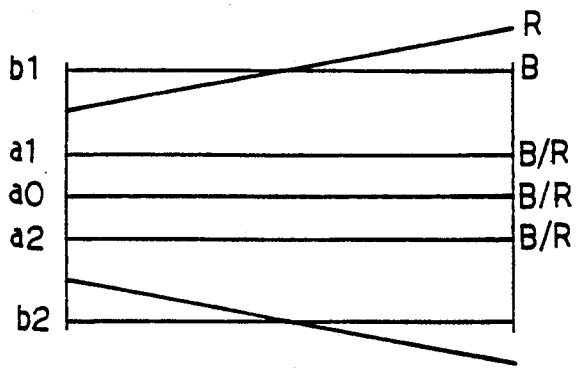
FIG. 1 PRIOR ART
FIG. 1 illustrates general misconvergence state of cathode ray tube.
Figure 2A:
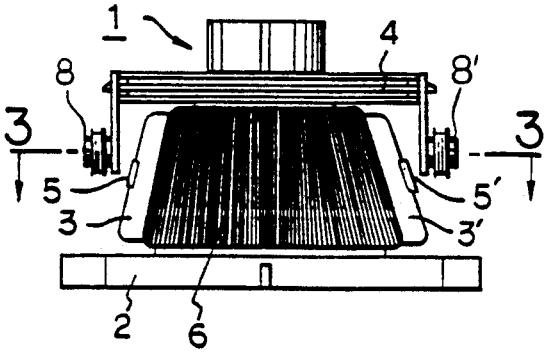
FIG. 2(A) PRIOR ART
FIGS 2A and 2B are respectively a front view and a side view showing a deflection yoke with the conventional saturable reactor attached thereon.
Figure 2B:
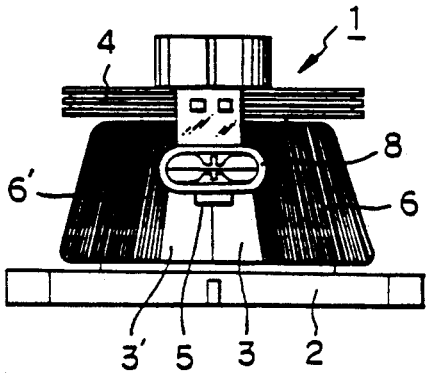
FIG. 2(B) PRIOR ART
Figure 3:
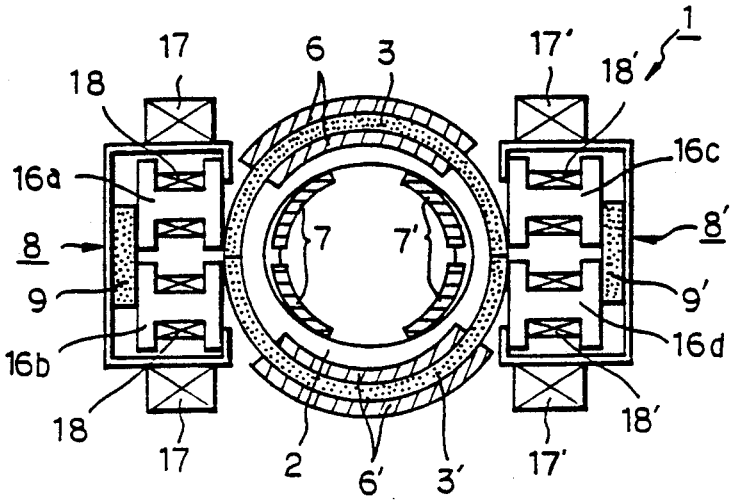
FIG. 3 PRIOR ART
FIG. 3 is a sectional view of the conventional saturable reactor taken along the line 3—3 shown in FIG. 2A.
Figure 7A:
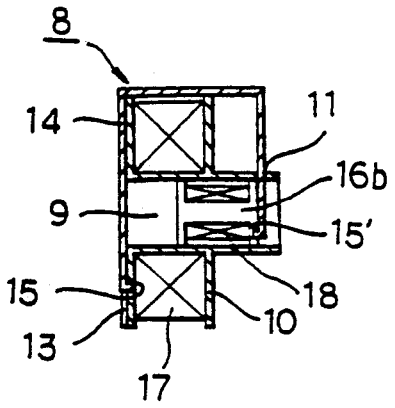
FIGS. 7(A) and 7(B) are sectional views of the saturable reactor taken along the lines 7A—7A and 7B—7B shown in FIG. 6.
Figure 7B:
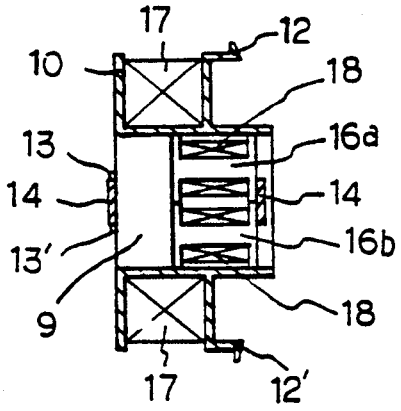

FIGS. 6, 7A and 7B are respectively perspective view, longitudinal sectional view and latitudinal sectional view of the saturable reactor 8 according to the present invention. As shown in these drawings, slots 11,11' are formed opposingly on a side of a bobbin 10 on which a vertical correcting coil 17 is wound.

Drum cores **16*a*,16*b* with horizontal correcting coils 18 wound thereon are installed within the bobbin 10, and a magnet 9 a first correcting means having a flux density of 30–50 Gauss is installed on a side of each of the drum cores 16*a*,16*b*, while securing steps 13,13' are formed on the outer side of the bobbin 10** in a symmetrical form.

A magnet piece 14 is inserted into the sots 11,11' in the horizontal direction and engaged with the securing steps 13,13', so that it should focus the C-shaped magnetic fluxes. Owing to the functions of bent pieces 15,15' which are formed on the magnet piece 14, the magnet 9 and the drum cores **16*a*,16*b* are in close contact, and the other saturable reactor 8'** has also the same construction.

Figure 8:
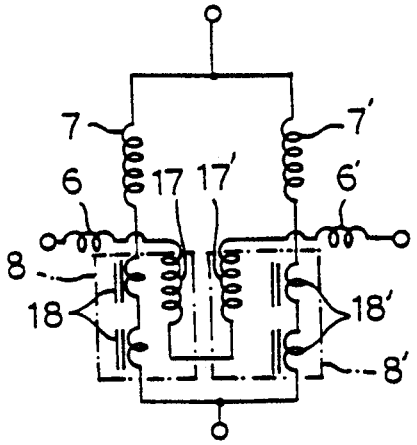
FIG. 8 is a circuit diagram of the convergence correcting circuit according to the present invention.

FIG. 8 is a circuit diagram for carrying out the present invention, and as shown in this drawing, horizontal correcting coils 18,18' wound on the drum cores **16*a*–16*b* are serially connected to horizontal deflection coils 7,7'**.

Also, vertical correcting coils 17,17' wound on the outer side of the bobbins 10,10' are serially connected to vertical deflection coils 6,6'.

Thus, the saturable reactors 8,8' for correcting the convergences according to the present invention perform the same functions, and act is opposite polarities.

Therefore the operations of the two saturable reactors 8,8' will be described below separately.

Figure 12:
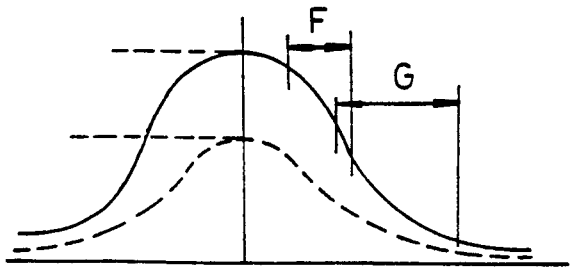
FIG. 12 illustrates the inductance variation wave diagram referring to the vertical magnetic fields of the saturable reactor according to the present invention.

FIG. 12 illustrates the wave diagram of the relationship between the inductance and the magnetic field for the saturable reactor 8. As shown in this drawing, if the magnetic field of the vertical correcting coil 17 is increased, the value of the inductance of the horizontal correcting coil 18 is decreased.

In the conventional technique described above, the value of the inductance is set to a relatively high using range F by using a strong magnet having a flux density of 300–600 Gauss and the portion having the low inductance is nonlinearly adjusted by means of a diode.

However, in order to accomplish the objects of the present invention, the inductance is lowered from the saturation level using a magnet(a first correcting means) of a lower Gauss(as shown by the dotted wave diagram); and the range G is selected as the using range and the magnetic fields of the portion having no variations of inductance values are focused by means of a magnet piece(a second correcting means).

That is, if a current having a saw tooth wave is supplied from a deflecting circuit to both the vertical deflecting coils 6,6' and the horizontal deflecting coils 7,7', there are produced magnetic fields which are capable of deflecting the electron beams emitted from an electron gun of the cathode ray tube.

Figure 9A:
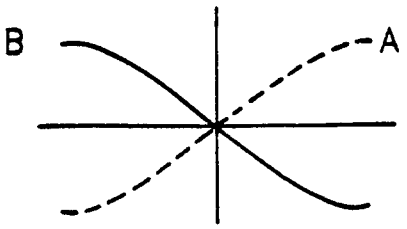
FIGS. 9 and 10 illustrate a convergence correcting wave diagram of the saturable reactor according to the present invention.

Under this condition, the magnetic fields produced by the vertical deflecting currents are synthesized with the magnetic fields produced by the vertical correcting coils 17,17' which are wound on the bobbins 10,10' of the saturable reactors 8,8'. In accordance with the variations of the synthesized magnetic field, the inductance of the horizontal correcting coils 18,18' which are wound on the drum cores **16*a*–16*b* takes the wave pattern of FIG. 9A. (Here, the wave pattern A represents the wave pattern of the horizontal correcting coil 18 of the saturable reactor 8, while the wave pattern B represents the wave pattern of the horizontal correcting coil 18' of the saturable reactor 8'**.)

Figure 9B:
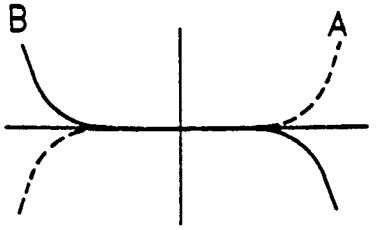
Figure 10:
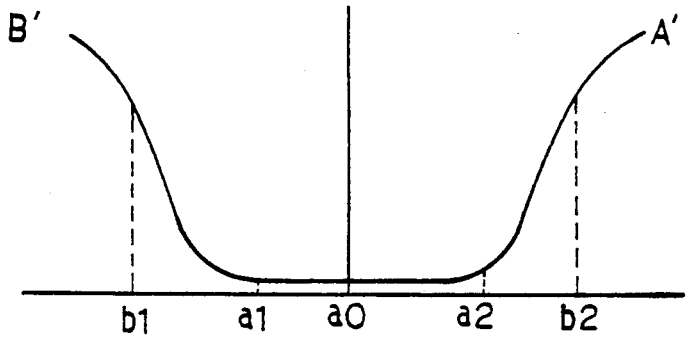
Figure 11:
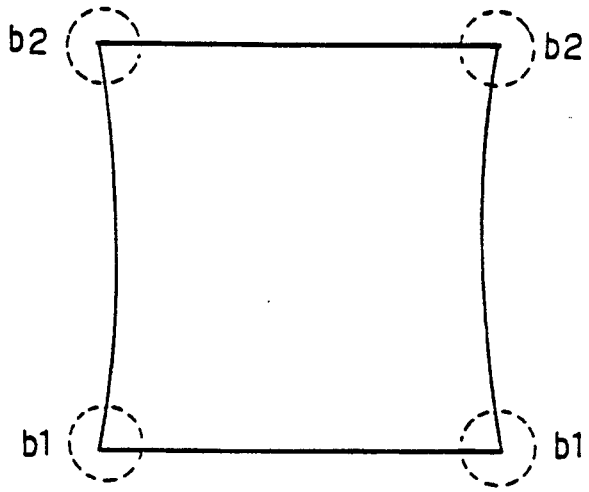
FIG. 11 illustrates a distortion correcting diagram of the picture according to the present invention.

Under this condition, the inductance of the horizontal correcting coil 18 is increased proportionately to the decrease of the vertical magnetic field, but the above inductance is lowered by lowering the saturation level by the magnets 9,9'(a first correcting means) which have 30~50 Gauss and which are attached on sides of the drum cores **16*a*, 16*b*. Thus the inductance is steeply decreased, while the other saturable reactor 8' functions in an inverse manner. As shown in FIG. 9, a curve having no variation of the inductance value is obtained for the central portion, and the magnetic fields of the magnets 9,9' and the vertical correcting coils 17,17' are focused by the magnet pieces 14,14'(a second correcting means). Further, the flux densities of the magnets 9,9' are stepped up, thereby obtaining convergence correcting curve A',B' as shown in FIG. 10**. Here, the portion A' of the curve corrects the picture during the upper vertical deflections, while the portion B' corrects the picture during the lower vertical deflections.

That is, no correction is done for the central portions Q1–Q2 of the cathode ray tube by the correcting curve of FIG. 10, but only the upper and lower peripheries $a_2 \sim b_2$, $a_1 \sim b_1$ are corrected, the compensations becoming possible by increasing the amount of Gauss by means of the magnet pieces 14,14', even if the amount of Gauss in the magnets 9,9' are small.

Further, in accordance with the strengthening of the vertical deflections, the inductances of the vertical deflection coils 6,6' are increased, and the horizontal sensitivity is decreased in accordance with the strength of the magnetic fields, thereby making it possible to correct the distortions occurring on the left and right corners of the picture.

That, is $Hp = HL \times I^2$ is established, where Hp represents a horizontal deflection sensitivity index, HL represents the inductance value of the horizontal correcting coils, and I represents the current of the horizontal correcting coils, and I represents the current flowing in the horizontal deflection coils. Therefore, the horizontal deflection sensitivity index Hp steeply decreases the inductance value HL if the currents I flowing through the horizontal correcting coils 18,18' are constant. Consequently, greater deflections are carried out, so that the distortions occurring on the corners of the picture should be corrected.

Meanwhile, the magnet pieces 14,14' not only focuses the magnetic fluxes, but also provides stabilities to the magnets 9,9' and the drum cores **16*a*–16*b***.

That is, as shown in FIGS. 5 to 7, the magnets 9,9' are inserted into the bobbins 10,10, and the drum cores **16*a*–16*d* are stacked on sides of the magnets 9,9'. Further, the magnet pieces 14,14' are inserted into the slots 11,11' of the bobbins 10,10' in the horizontal direction in such a manner that the C-shaped magnet pieces 14,14' should be wound around the circumference of the bobbins 10,10', and should be secured by being engaged with the securing steps 13,13' formed on a side of the bobbins 10,10'. Further, the bent pieces 15 which are formed on the magnetic pieces 14,14 can firmly support the bobbins 10,10' and the drum cores 16*a*–16*b*, and therefore, the displacements of the magnets 9,9' and the drum cores 16*a*–16*d*** can be prevented. This brings the results that misconvergence corrections can be effected without a separate securing device, and that the assembling work is simplified, thereby improving the productivity.

Figure 13A:
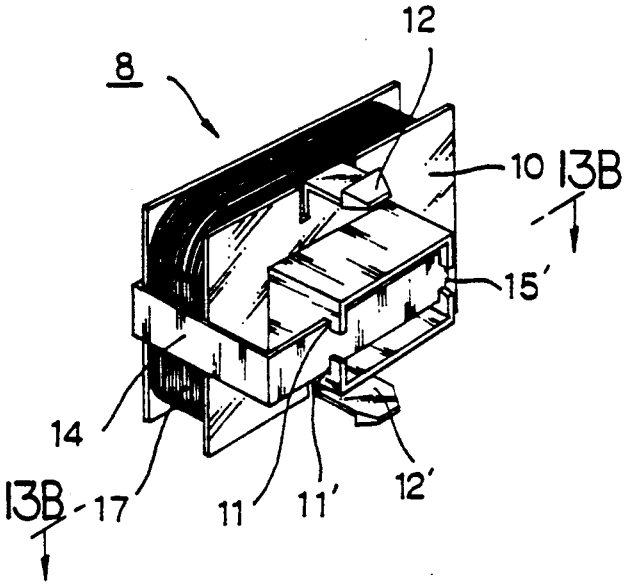
FIG. 13(A) is a perspective view showing another embodiment of the saturable reactor according to the present invention.
Figure 13B:
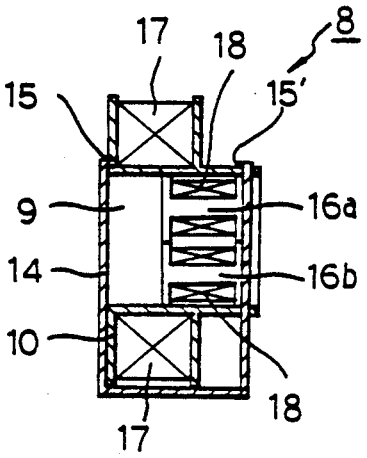
FIG. 13(B) is a sectional view of the saturable reactor taken along the line 13B—13B shown in FIG. 13(A).
Figure 14A:
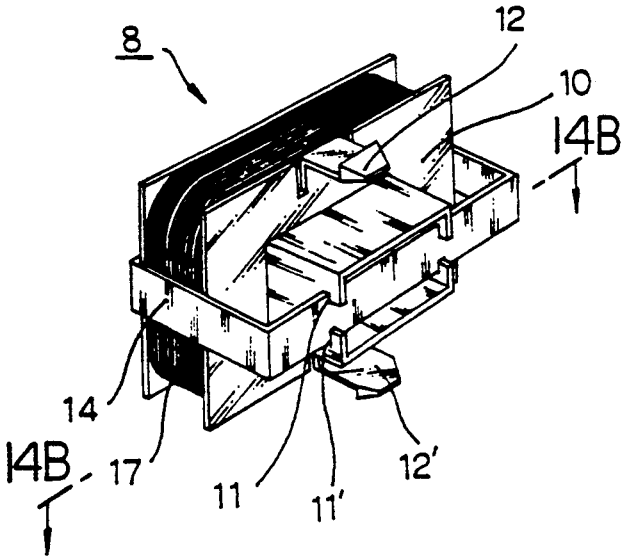
FIG. 14(A) is a perspective view showing still another embodiment of the saturable reactor according to the present invention.
Figure 14B:
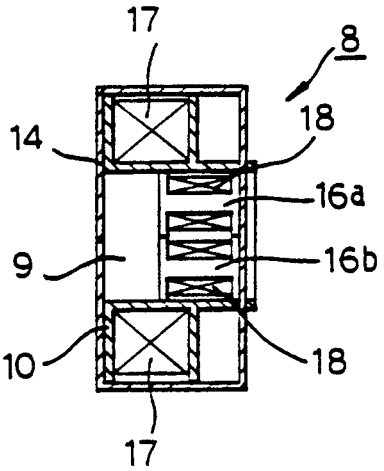
FIG. 14(B) is a sectional view of the saturable reactor taken along the line 14B—14B shown in FIG. 14(A).

FIG. 13 and FIG. 14 illustrates another embodiment of the saturable reactor according to the present invention.

In FIG. 13, the C-shaped magnet piece 14 increasing the amount of gauss the magnet 9 by focusing the magnet field is installed vertically the circumference of the bobbin 10, so that the drum cores **16*a* and 16*b* and the magnet 9** are fixed more solidly.

In FIG. 14, the magnet piece 14 enclosed the vertical correcting coil 17 wound on the circumference, the magnet 9 and the drum cores **16*a* and 16*b* at the horizontal direction, so that a focusing effect of the magnet generated from the magnet 9 and the vertical correcting coil 17 is highly improved, thereby increasing the amount of gauss of the magnet 9**.

According to the convergence correcting device of the present invention as described above, the bobbins are wound with the vertical correcting coils, and slots are provided in an opposingly facing manner on each side of the bobbins. Further, the inner part of the bobbins accommodation the drum cores on which the horizontal correcting coils are wound, while the magnet having a flux density of 30–50 gauss is installed on one side of the drum cores, with the securing step being formed on a side of each of the bobbins. A magnet piece(a second correcting means) is inserted into each of the slots of the bobbins, and the magnet piece is secured by the securing step of the bobbins. These magnet pieces focus the magnetic fluxes, and the bent pieces formed on the magnet pieces make the magnets and the drum cores closely contact each other, thereby forming a saturable reactor. Thus, the value of the inductance of the horizontal correcting coils which is varied in accordance with the magnetic fields is significantly reduced by means of a magnet having a flux density of 30–50 gauss. Further, the magnetic field is focused by means of the magnet pieces secured on the bobbins in order to maintain the inductance value at a constant level.

Consequently, misconvergences which are liable to occur on a 20 inch cathode ray tube can not only be accurately corrected, but also the distortions occurring on the upper and lower peripheries of the picture can be corrected. Further, the magnets and the drum cores are prevented from displacements by the magnet pieces, thereby improving the picture quality, facilitating the assembling, and enabling to save the manufacturing costs through the improvements of the productivity.

The invention is in no way limited to the embodiment described hereinabove. Various modifications of disclosed embodiment as well as other embodiments of the invention will become apparent to persons skilled in the art upon reference to the description of the invention. It is therefore contemplated that the appended claims will cover any such modifications or embodiments as fall within the true scope of the invention.

What is claimed is:

1. A device for correcting convergence of an in-line type color picture tube of a self convergence system, comprising:

a pair of horizontal deflection coils;

a pair of vertical deflection coils; and a pair of saturable reactors having respectively a permanent magnet for D.C. magnetic bias, a vertical correction coil connected to a respective said vertical deflection coil in series, the vertical correction coils of said pair of saturable reactors respectively being wound to generate magnetic flux in the same direction and opposite the direction of magnetic flux generated by the permanent magnets, a pair of horizontal correction coils respectively connected to said horizontal deflection coils and having inductance thereof varied by magnetic flux from the respective said vertical correction coils, and a leakage magnetic flux guide means of c-shape which guides leakage flux from the permanent magnets to said pair of horizontal correction coils for increasing the amount of magnetic flux which determines a reference point of operation for each said horizontal correction coil to locate said reference point in a saturation region of said horizontal correction coil.

2. A device as claimed in clam 1, wherein said leakage magnetic flux guide means comprises a band in the form of a C-shaped magnetic piece adjacent to each said permanent magnet.

3. A device as claimed in claim 2, wherein said C-shaped magnetic piece crosses said vertical correction coil.

4. A device as claimed in claim 2, comprising projecting engaging pieces on each of said saturable reactors for engagement thereof in insertion holes in a base plate fixed to a neck member accommodating a neck of a picture tube.

5. A device as claimed in claim 2, wherein each saturable reactor comprises a bobbin containing a respective permanent magnet and horizontal correction coil, said bobbin having slots into which said C-shaped magnetic piece is fitted in opposition to said horizontal correction coils.

6. A device as claimed in claim 5, wherein each saturable reactor is circumferentially wound with a respective vertical correction coil.

7. A device as claimed in claim 6, wherein said C-shaped magnetic piece extends crosswise on said bobbin across the vertical correction coil.

8. A device as claimed in claim 6, wherein said C-shaped magnetic piece has opposite ends with bent pieces at said ends engaging in said slots in said bobbin.

9. A device as claimed in claim 8, wherein the bobbins of the saturable reactors are disposed adjacent to one another and mounted on a flat base plate on one side of the picture tube, said base plate being fixed to a neck member accommodating a neck of the picture tube.

10. A device as claimed in claim 5, comprising drum cores in each said bobbin onto which said horizontal correction cores are wound, said permanent magnet being disposed adjacent to said drum cores and said horizontal correction coils, said C-shaped magnetic piece having a portion extending adjacent to said horizontal correction cores on a side thereof remote from said permanent magnetic, said C-shaped magnetic piece including another portion extending across said vertical correction coil.

11. A device as claimed in claim 10, wherein said C-shaped magnetic piece contacts said cores and said permanent magnet.

12. A device as claimed in claim 11, wherein said C-shaped magnetic piece supports said drum cores.

* * * * *